US011950739B2

(12) United States Patent
Boldt

(10) Patent No.: US 11,950,739 B2
(45) Date of Patent: Apr. 9, 2024

(54) WASH ARM

(71) Applicant: ILLINOIS TOOL WORKS INC., Glenview, IL (US)

(72) Inventor: Adrian Boldt, Offenburg (DE)

(73) Assignee: ILLINOIS TOOL WORKS INC., Glenview, IL (US)

( * ) Notice: Subject to any disclaimer, the term of this patent is extended or adjusted under 35 U.S.C. 154(b) by 405 days.

(21) Appl. No.: 17/176,553

(22) Filed: Feb. 16, 2021

(65) Prior Publication Data

US 2021/0259506 A1 Aug. 26, 2021

(30) Foreign Application Priority Data

Feb. 21, 2020 (DE) ..... 102020104642.1

(51) Int. Cl.
*A47L 15/00* (2006.01)
*A47L 15/42* (2006.01)

(52) U.S. Cl.
CPC ..... *A47L 15/0057* (2013.01); *A47L 15/0076* (2013.01); *A47L 15/4278* (2013.01); *A47L 2501/20* (2013.01)

(58) Field of Classification Search
CPC ..... A47L 15/0057; A47L 15/0076; A47L 15/4278; A47L 2501/20; A47L 15/4282; A47L 15/22
See application file for complete search history.

(56) References Cited

U.S. PATENT DOCUMENTS 7,475,696 B2 1/2009 Vanderroest
2018/0110394 A1* 4/2018 Heisele ..... A47L 15/23

FOREIGN PATENT DOCUMENTS

| | | | |
|---|---|---|---|
| DE | 102014100002 | A1 | 7/2015 |
| LU | 92894 | | 6/2017 |
| WO | WO 2016086961 | A1 | 6/2016 |
| WO | WO 2016169737 | A1 | 10/2016 |
| WO | WO 2019145381 | A1 | 8/2019 |

* cited by examiner

*Primary Examiner* — Michael E Barr
*Assistant Examiner* — Pallavi Chitta
(74) *Attorney, Agent, or Firm* — THOMPSON HINE LLP

(57) ABSTRACT

A wash arm (1) for a commercial dishwasher (50), with a wash arm housing (2) which extends in a longitudinal direction and in which at least one inlet for supplying washing liquid and at least one nozzle opening for spraying the supplied washing liquid are formed, wherein at least one cleaning opening (4) with an assigned opening/closing mechanism (5) is provided preferably at at least one end region of the wash arm housing (2), wherein the opening/closing mechanism (5) is designed to automatically open for thorough rinsing of at least one region of the wash arm housing (2) in particular as required and to automatically close for ending the thorough rinsing of the at least one region of the wash arm housing (2) in particular as required.

12 Claims, 4 Drawing Sheets

WASH ARM

TECHNICAL FIELD

The present invention relates in general to commercial dishwashing and, in particular, to a wash arm for a dishwasher, in particular a commercial utensil or crockery dishwasher. The wash arm according to the invention is in particular part of a rotating or stationary washing and rinsing system of a conveyor warewasher or a box-type warewasher.

BACKGROUND

Conveyor warewashers are in particular flight-type warewashers or rack conveyor warewashers. Conveyor warewashers are conventionally used in the commercial sector. In contrast to box-type warewashers, in which the washware to be cleaned remains in a fixed position in the machine during the cleaning, in the case of conveyor warewashers the washware is transported through various treatment zones of the conveyor warewasher.

Box-type warewashers are dishwashers which can be manually loaded and unloaded. Box-type warewashers can be rack-type push-through warewashers, also called hood-type warewashers, or front loader warewashers. Front loader warewashers can be under-counter machines, counter-top machines or free-standing front-loader warewashers.

A dishwasher in the form of a box-type warewasher conventionally has a treatment chamber for cleaning washware. Below the treatment chamber there is generally a wash tank in which liquid from the treatment chamber can flow back because of gravity. The wash tank contains washing liquid which is conventionally water to which detergent can optionally be added.

A dishwasher in the form of a box-type warewasher furthermore has a wash system with a wash pump, a line system connected to the wash pump, and a multiplicity of spray nozzles formed in at least one wash arm. The washing liquid in the wash arm can be conveyed by the wash pump via the line system to the spray nozzles and can be sprayed by the spray nozzles in the treatment chamber onto the washware to be cleaned. The sprayed washing liquid then flows back into the wash tank.

Irrespective of whether the dishwasher is in the form of a box-type warewasher or a conveyor warewasher, the dishwashers under consideration here and, in particular, commercial dishwashers conventionally comprise at least one wash system which has a wash pump which ensures a virtually constant water circulation rate for the duration of a wash process in the treatment chamber (in the case of box-type warewashers) or in the respective treatment zone (in the case of conveyor-type warewashers). The respective wash pumps of the wash systems are switched on and switched off by a control device (machine controller) which is part of the dishwasher.

Each wash system is generally assigned a screen system for separating out solid particles of dirt from the washing liquid which is sprayed via the spray nozzles onto the washware to be cleaned. Screen systems of this type are preferably designed in such a manner that they can be removed manually from the dishwasher, for example in order to be cleaned.

The dishwasher is or has to be cleaned at the end of each working day. This involves a large number of working steps which have to be performed manually. In order to clean, for example, a conveyor-type warewasher, the wash arms and the screen systems of the individual wash systems first have to be removed. Since a conveyor-type warewasher generally has a plurality of wash zones arranged one behind another, and therefore a corresponding large number of wash systems, these working steps have to be carried out several times.

The removed screen systems are then manually spray-washed with water and additionally manually scrubbed, depending on the degree of soiling. When the wash arms are removed, the cleaning end caps which are conventionally arranged at the end of the wash arms are first removed, so that each individual wash tube of a wash arm can be subsequently flushed with water. Finally, the wash arm is completely cleaned, that is to say spray-washed and manually scrubbed. The final-rinse arms are likewise spray-washed with water and optionally manually scrubbed. Final-rinse arms are generally not provided with cleaning end caps since no dirt is expected to be found inside the final-rinse tubes.

The loading zone of a conveyor-type warewasher, which is the treatment zone which is soiled to the greatest extent, is spray-washed with water and sometimes (if necessary) manually cleaned with a cleaning cloth and optionally with the aid of a detergent solution during the cleaning process.

To clean a box-type warewasher at the end of a working day, the wash arms have to be cleaned in a similar manner.

SUMMARY

The invention is based on the object of specifying a dishwasher of the type mentioned at the beginning, in which the cleaning which has to be carried out at the end of a working day can be made more efficient. A particular object is to specify a dishwasher in which at least some of the working steps which are required for cleaning the dishwasher are carried out in an automated manner in order to thereby save on staff and at the same time to be able to reduce the resources (water, energy, chemicals) used for the cleaning.

To achieve this object, according to the invention a wash arm for an in particular commercial dishwasher as claimed in independent patent claim 1 is proposed, wherein advantageous developments of the wash arm according to the invention are specified in the dependent claims.

The object on which the invention is based is furthermore achieved by a wash system as claimed in further independent patent claim 13 and by a method as claimed in further independent patent claim 15.

Accordingly, the invention relates in particular to a wash arm for an in particular commercial dishwasher, wherein the wash arm has a wash arm housing which extends in a longitudinal direction and in which at least one inlet for supplying washing liquid and at least one nozzle opening for spraying the supplied washing liquid are formed. The wash arm according to the invention can be mounted in a rotating manner in a treatment chamber or treatment zone of a dishwasher, as is frequently the case, for example, in box-type warewashers. Alternatively thereto, it is, however, also conceivable for the wash arm to be arranged in a stationary manner with respect to the treatment chamber or treatment zone of the dishwasher, which is frequently the case in conveyor warewashers.

In order to be able to carry out cleaning of the wash arm in an automated manner, and in order to reduce malfunctions occurring in particular during operation of the dishwasher and to minimize the frequency of cleaning and maintenance operations, it is provided according to the invention that at least one cleaning opening with an assigned opening/closing mechanism is formed preferably at at least one end region of the wash arm housing. The opening/closing mechanism is designed to automatically open for thorough rinsing of at least one region of the wash arm housing. The opening/closing mechanism is furthermore designed to automatically close for ending the thorough rinsing of the at least one region of the wash arm housing in particular as required.

In particular, the opening/closing mechanism is designed to automatically open the at least one cleaning opening assigned to the opening/closing mechanism in order to thoroughly rinse at least one region of the wash arm housing. The opening/closing mechanism is furthermore designed to automatically close the at least one cleaning opening assigned to the opening/closing mechanism for ending the thorough rinsing of the at least one region of the wash arm housing in particular as required.

According to embodiments of the wash arm according to the invention, at least one cleaning opening with an assigned opening/closing mechanism is in each case provided at at least one end region of the wash arm housing, and preferably at the two opposite end regions of the wash arm housing.

In particular, the at least one cleaning opening can be provided in each case in an end side of the wash arm housing, and it can face in the longitudinal direction in which the wash arm housing extends.

The advantages which can be realized with the solution according to the invention are obvious: by means of the provision of at least one cleaning opening with an assigned opening/closing mechanism, it is possible to automatically thoroughly rinse the wash arm housing, with manual intervention not being required since the opening/closing mechanism is designed to automatically open and to close again the cleaning opening assigned thereto as required.

In particular if the at least one cleaning opening is formed in an end region of the wash arm housing and preferably in an end-side end region of the wash arm housing, particularly efficient thorough rinsing of the wash arm or of the wash arm housing is possible since the at least one cleaning opening arranged on the end side and preferably at the end lies in the main flow direction of the cleaning liquid. This effectively prevents the cleaning liquid from backing up in the wash arm or in the wash arm housing during the cleaning of the wash arm or of the wash arm housing.

In principle, with the solution according to the invention, the cleaning liquid can be conducted through the wash arm housing at a greater speed, and therefore dirt can be efficiently rinsed out of the wash arm housing. Investigations have shown that by arranging the at least one cleaning opening on the end side, the time required for cleaning the wash arm housing and quantity of cleaning liquid can be significantly reduced in comparison to cleaning openings which are oriented obliquely or transversely with respect to the longitudinal direction of the wash arm housing.

Various alternatives are suitable as the opening/closing mechanism. For example, it is conceivable for the opening/closing mechanism to have an electrically or magnetically actuable actuating element in order to be able to open and/or close the at least one cleaning opening as required.

According to preferred realizations of the wash arm according to the invention, it is provided, by contrast, that the opening/closing mechanism has a hydraulically actuable actuating element for opening and/or closing the at least one cleaning opening as required.

For example, it is conceivable in this connection for the opening/closing mechanism to have a linearly acting non-return valve, wherein the non-return valve has a shut-off body which is displaceable relative to the wash arm housing and relative to the at least one cleaning opening, which is assigned to the opening/closing mechanism, preferably in a pure linear movement between an open position, in which the at least one cleaning opening is fluidically connected to the inlet of the wash arm, and a closed position, in which a fluidic connection between the at least one cleaning opening and the inlet is interrupted.

Instead of a non-return valve, it is also conceivable for the opening/closing mechanism to have a shut-off slide which is mounted in the corresponding end region of the wash arm in such a manner that the shut-off slide is displaceable in a pure linear movement relative to the wash arm housing and relative to the at least one cleaning opening, which is assigned to the opening/closing mechanism, between an open position, in which the at least one cleaning opening is fluidically connected to the inlet of the wash arm, and a closed position, in which a fluidic connection between the at least one cleaning opening and the inlet is interrupted.

Irrespective of which specific embodiment is selected for the opening/closing mechanism, it is preferred that the shut-off element (actuating element, shut-off slide, etc.) belonging to the opening/closing mechanism is movable between the open and closed position preferably in a pure linear movement or pivoting movement, wherein said linear movement runs preferably longitudinally or parallel to the direction of longitudinal extent of the wash arm housing. This ensures that no solid particles of dirt can obstruct the manipulation (the opening or closing) of the at least one cleaning opening.

Investigations have shown that, for example, during a pivoting movement of a shut-off element assigned to the opening/closing mechanism, solid particles of dirt tend to accumulate in the pivoting path of the actuating element and obstruct or interfere there with the movement of the actuating element, with the result that it is not ensured that the opening/closing mechanism still functions properly, in particular after a prolonged operating period.

For this reason, it is provided, according to a preferred realization of the wash arm according to the invention, that the shut-off slide has a guide sleeve and a shut-off body protruding radially from the guide sleeve, wherein the guide sleeve is mounted in a linearly movable manner on a guide pin extending in the longitudinal direction of the wash arm housing. The guide pin here preferably has an axis of longitudinal extent which is oriented coaxially with respect to an axis of longitudinal extent of the wash arm housing.

In particular in this specific embodiment, it is appropriate for the shut-off body of the shut-off slide to have at least one passage, the passage opening of which pointing in the direction of the end side of the wash arm housing is positioned/placed in such a manner that, in the closed position of the shut-off slide, the passage opening pointing in the direction of the end side of the wash arm housing does not coincide with the at least one cleaning opening.

This embodiment is distinguished by its simple and robust design.

According to developments of the last-mentioned embodiment of the wash arm according to the invention, it is provided that the passage opening of the at least one passage, said passage opening pointing in the direction of the end side of the wash arm housing, lies closer to an axis of extent of the wash arm with respect to the axis of longitudinal extent of the wash arm housing than the at least one cleaning opening. In other words, the passage opening of the at least one passage, said passage opening pointing in the direction of the end side of the wash arm housing, is spaced apart less far radially with respect to the axis of longitudinal extent of the wash arm housing from an axis of extent of the wash arm than the at least one cleaning opening.

Alternatively thereto, it is, however, also conceivable that the opening/closing mechanism, preferably in the corresponding end region of the wash arm, has a pivoting element which serves as a shut-off body and is designed and/or mounted in such a manner that the pivoting element is pivotable in a preferably pure pivoting movement relative to the wash arm housing and relative to the at least one cleaning opening, which is assigned to the opening/closing mechanism, between an open position, in which the at least one cleaning opening is fluidically connected to the inlet of the wash arm, and a closed position, in which a fluidic connection between the at least one cleaning opening and the inlet is interrupted.

According to developments of this embodiment, it is provided that the pivoting element is assigned a pretensioning element, in particular in the form of a spring, with which the pivoting element is pretensioned into its open position.

The pretensioning force exerted on the pivoting element by the pretensioning element and/or the open position of the pivoting element are/is preferably selected in such a manner that the pretensioning force is overcome as soon as a static pressure in the interior of the wash arm housing reaches or exceeds a previously defined or definable minimum pressure value.

Alternatively thereto, it is, however, also conceivable that the opening/closing mechanism, preferably in the corresponding end region of the wash arm, has an in particular spherical closure element (ball) which is accommodated in a cage region, serves as a shut-off body and is designed and/or mounted in the cage region in such a manner that the closure element is movable relative to the wash arm housing and relative to the cage region and relative to the at least one cleaning opening, which is assigned to the opening/closing mechanism, between an open position, in which the at least one cleaning opening is fluidically connected to the inlet of the wash arm, and a closed position, in which a fluidic connection between the at least one cleaning opening and the inlet is interrupted.

In this embodiment, it is appropriate that the closure element and the cage region are preferably designed in such a manner that the closure element is transferred by the water pressure prevailing in the interior of the wash arm housing into its closed position and is held there as soon as a static pressure in the interior of the wash arm housing reaches or exceeds a previously defined or definable minimum pressure value, and that the closure element transfers by gravity into its open position as soon as a static pressure in the interior of the wash arm housing falls short of the previously defined or definable minimum pressure value.

In the abovementioned embodiments of the opening/closing mechanism and of the shut-off body, it has been shown that what is referred to as the draining phase can be significantly reduced. The draining phase immediately follows the washing phase during which the detergent solution (washing liquid) is pumped out of the wash tank of the dishwasher via a pipe system into the wash arms with the aid of a wash pump. The washware to be cleaned is acted upon with the washing liquid via the wash arms. In the process, the dirt is detached from the washware and passed into the detergent solution.

This wash phase is followed by the draining phase during which there is a wait of a few seconds until the washing liquid/detergent solution has drained from the wash system and the wash arms and flowed back into the wash tank. This avoids the detergent solution dripping onto the washware in the subsequent program steps, which may make the washing result less good.

By the at least one cleaning opening being opened after the end of the wash phase, the draining phase can be significantly reduced. The draining phase is reduced even further if—as explained—the passage opening of the shut-off body of the opening/closing mechanism, said passage opening pointing in the direction of the end side of the wash arm housing, is arranged closer to the axis of extent of the wash arm with respect to the axis of longitudinal extent of the wash arm housing than the at least one cleaning opening.

The use of a shut-off body which is mounted movably in the end region of the wash arm and is in the form of a shut-off slide, a pivoting element and/or a spherical closure element has the further advantage that an effective control surface pointing in the longitudinal direction of the wash arm housing is provided via the shut-off body. In particular, the size of the effective control surface pointing in the longitudinal direction of the wash arm housing is previously definable in a simple manner such that the response behavior of the shut-off body and in particular of the opening/closing mechanism is previously adjustable very precisely in a simple manner, in particular in respect of the critical hydraulic pressure within the wash arm housing, at which the shut-off body is moved into its closed position by the hydraulic pressure.

According to a further aspect of the present invention, it is provided that the opening/closing mechanism of the wash arm is accommodated in a (dedicated) housing, wherein the housing of the opening/closing mechanism is fastenable, preferably releasably, to the wash arm housing, which is open at its end region. In particular, in this embodiment, the at least one cleaning opening is provided on an end-side end region of the housing of the opening/closing mechanism.

This aspect according to the invention has the advantage that the entire mechanical system belonging to the opening/closing mechanism can be removed in a simple manner and optionally repaired or replaced. Furthermore, this aspect according to the invention is also suitable for retrofitting conventional wash arms retrospectively with a corresponding opening/closing mechanism.

The invention relates not only to a wash arm of the previously discussed type, but also to a rinsing arm system for a dishwasher, in particular a commercial utensil or crockery dishwasher, wherein the rinsing arm system has at least one wash arm of the type according to the invention and at least one rinsing arm, which is formed separately from the at least one wash arm, for spraying rinsing liquid.

The invention furthermore relates to a dishwasher, in particular commercial utensil or crockery dishwasher, wherein the dishwasher has at least one treatment chamber or at least one treatment zone, in which washing liquid and/or rinsing liquid is sprayed, wherein at least one wash arm of the type according to the invention is provided for spraying the washing liquid and/or the rinsing liquid.

Finally, the invention relates to a method for cleaning washware, in which a washing liquid is sprayed via a wash arm of the type according to the invention onto the washware to be treated, wherein the wash arm is thoroughly rinsed preferably at previously defined or definable times and/or in the event of previously defined or definable events, specifically by the at least one cleaning opening of the wash arm being opened.

BRIEF DESCRIPTION OF THE DRAWINGS

The invention will be described in more detail below with reference to the attached drawings, in which.

DETAILED DESCRIPTION

Figure 1:
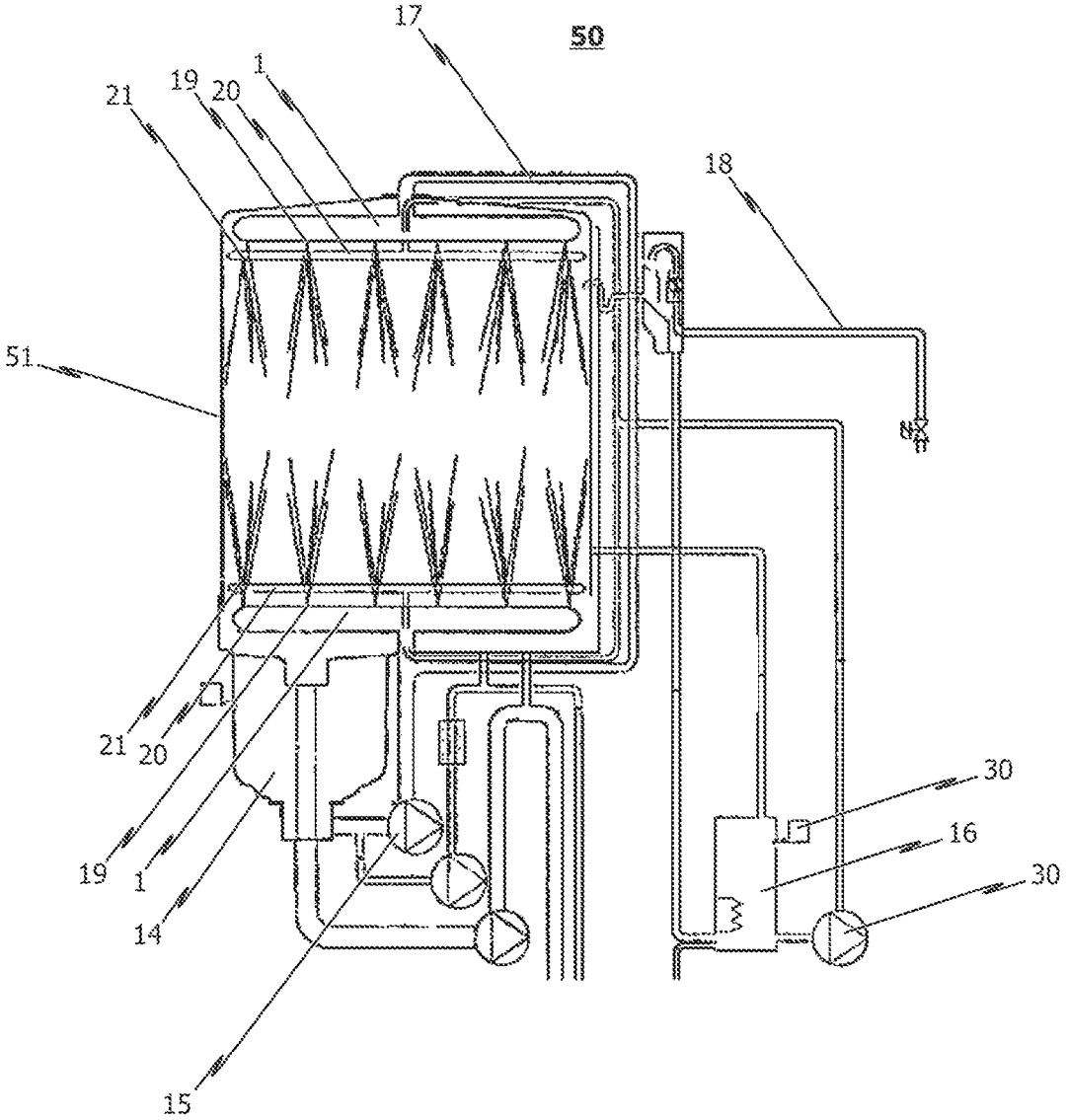
FIG. 1 shows a hydraulic diagram of an exemplary embodiment of the dishwasher according to the invention.

Commercial dishwashers are designed to clean large amounts of washware in the shortest possible time. Thus, in the case of a hood-type warewasher of this applicant, the duration of the preset standard program, which is conventionally used for normally soiled washware, such as plates, dishes, cups and glasses, is only 70 seconds, that is to say the theoretical capacity of the machine is up to 52 washware racks per hour.

Virtually without exception, commercial dishwashers are provided with a rotating washing and rinsing system. A washing and rinsing system conventionally consists of a wash arm and a rinsing arm. As can be gathered from the hydraulic diagram according to FIG. 1, a commercial dishwasher which is in the form of a box-type warewasher conventionally has an upper and a lower washing and rinsing system.

During operation, the washing liquid (detergent solution) is pumped out of the wash tank and via a pipe system to the wash arms with the aid of a wash pump. The washware to be cleaned is acted upon with the washing liquid (detergent solution) via the wash arms. In the process, the dirt is detached from the washware and passed into the detergent solution.

The washing phase is followed by what is referred to as the draining phase. There is a wait here of a few seconds until the detergent solution has drained out of the wash system and the wash arms and flowed back into the wash tank. This avoids the detergent solution dripping onto the washware in the following program steps, which may cause the washing result to be less good.

Some of the washing liquid (detergent solution) is subsequently pumped into the wastewater system. In the following fresh water rinsing phase, the same amount is pumped out of the boiler via the rinsing arms into the wash tank. In the case of commercial dishwashers, this procedure is repeated for each program cycle.

At the end of the dishwashing shift, the dishwasher operator has the task of cleaning the dishwasher. For this purpose, the wash arms have to be checked at regular intervals. If some of the wash nozzles are clogged, the wash arm has to be cleaned. However, this means a large manual outlay since, for this purpose, the operator first of all has to remove the upper and lower washing and rinsing system. In the next step, the cleaning stoppers of the corresponding wash arm have to be opened. The clogged nozzles are subsequently cleaned with a suitable (in particular pointed) object. In the next step, the wash arm is thoroughly rinsed with fresh water. The cleaning caps are then reinserted and the cleaned wash and rinsing arms are finally refitted in the dishwasher.

If clogged nozzles of the wash arm are not identified, the cleaning result becomes increasingly poorer. This means that the washware is no longer sufficiently cleaned and has to be placed back into the dishwasher.

The aim of the present invention is to specify a solution with which the wash arms of a dishwasher no longer, as previously customary, have to be cleaned manually. For this purpose, it is proposed according to the invention that the wash arms have a rinse-through function which ensures that the wash arms are rinsed through at regular intervals. Clogging of the wash arm nozzles can thereby be effectively avoided in order thereby to ensure a consistently good cleaning result. Furthermore, the manual cleaning outlay for the wash arms is additionally reduced to a minimum and the intervals for checking the wash arms are extended. Ultimately, the solution according to the invention makes it possible for rapid emptying of the wash arm after washing to be ensured in order thereby to realize a shorter draining phase and to reduce detergent residues on the washware.

The wash arm according to the present invention has cleaning openings provided at the ends. Said cleaning openings are closable. When the wash pump is switched on, the detergent solution is pumped into the wash arms. In the process, a counterpressure builds up inside the wash arm. Said counterpressure is used to close the cleaning openings. This has the result that particles of dirt which may be located in the wash arm are rinsed out of the wash arm. The wash arm is thus thoroughly rinsed twice within one program cycle.

A further positive secondary effect of this solution is that, when the cleaning openings are opened when the wash pump is switched off, the washing liquid (detergent solution) can escape more rapidly from the wash arm, as a result of which the draining phase is shortened, which in turn has the result that the theoretical rack capacity, i.e. washware racks washed per hour, can be increased.

In the following detailed description of the figures, identical or identically acting components are provided with the same reference signs.

The illustration according to FIG. 1 shows an exemplary embodiment of the dishwasher 50 according to the invention. It is pointed out that this illustration has only the components required for understanding the invention. The dishwasher 50 is in particular a commercial crockery or utensil dishwasher which is in the form of a box-type warewasher. Of course, it is likewise possible to design the dishwasher 50 according to the invention as a conveyor warewasher. The structural modifications necessary for this purpose are of course known to a person skilled in the art.

The dishwasher 50 illustrated in FIG. 1 has a treatment chamber 51 with an assigned wash tank 14. The wash tank 14 serves for receiving a treatment liquid which can be conveyed via a wash pump 15 to a multiplicity of wash nozzles 19. In particular according to the illustrated embodiment, the wash nozzles 19 are located in the upper and lower region of the treatment chamber 51 where a washing/rinsing system with an associated wash arm 1 and a rinsing arm 20 is in each case provided. The upper and lower wash arm are connected to the wash tank 14 via a wash line 17. Since the wash tank 14 is located in the lower region of the treatment chamber 51, the treatment liquid can thereby be recirculated after spraying the washware.

The dishwasher 50 which is shown furthermore has at least one final rinsing system for providing a final rinsing liquid. In the embodiment illustrated, the final rinsing system consists of a storage container 30 which includes a final rinsing concentrate. As can be seen from FIG. 1, the storage container 30 of the final rinsing system is connected to a boiler 16 via a fluid line. The boiler 16 has a fresh water connection 18 via which fresh water (e.g. mains water) can be introduced into the boiler 16. The fresh water in the boiler 16 is heated by a heating device and mixed with the final rinsing concentrate of the storage container 30. For this purpose, the final rinsing concentrate is conveyed out of the storage container 30 to the boiler 16 by a metering pump. The final rinsing liquid arising from a combination of fresh water and final rinsing concentrate can be conveyed via a final rinsing pump 21 and the associated final rinsing lines to a multiplicity of final rinsing nozzles. Similarly as in the case of the wash nozzles 19, the final rinsing nozzles are also located in the interior of the treatment chamber 51 of the dishwasher 50, specifically in each case in an upper and lower rinsing arm 20.

A first exemplary embodiment of the wash arm 1 according to the invention will be described in more detail below with reference to the illustrations in FIG. 2 and FIG. 3.

Figure 2:
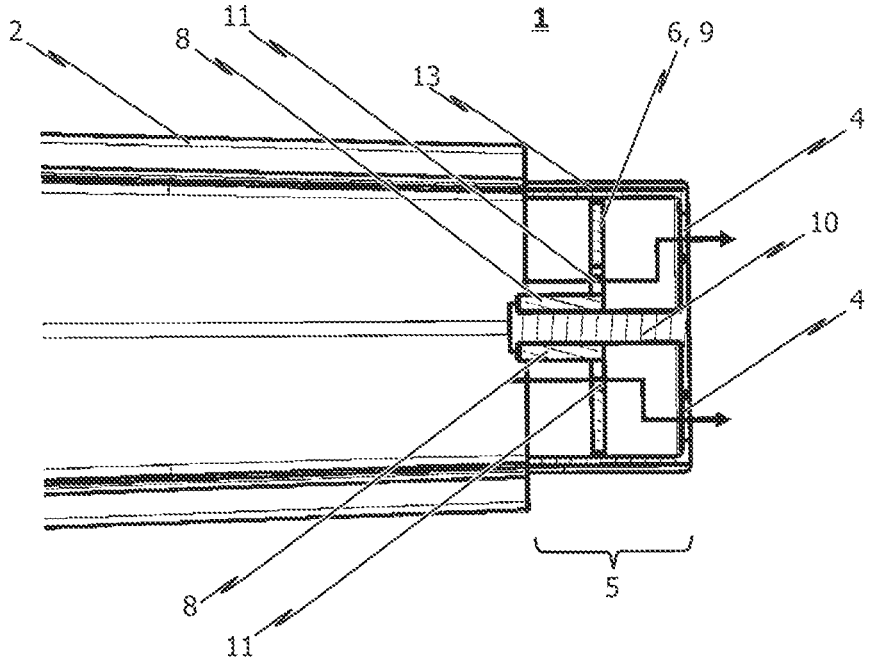
FIG. 2 shows, schematically and in a sectional view, an end region of a first embodiment of the wash arm of the exemplary embodiment of the dishwasher according to the invention in a state in which the cleaning openings provided on the end side in the wash arm are open.
Figure 3:
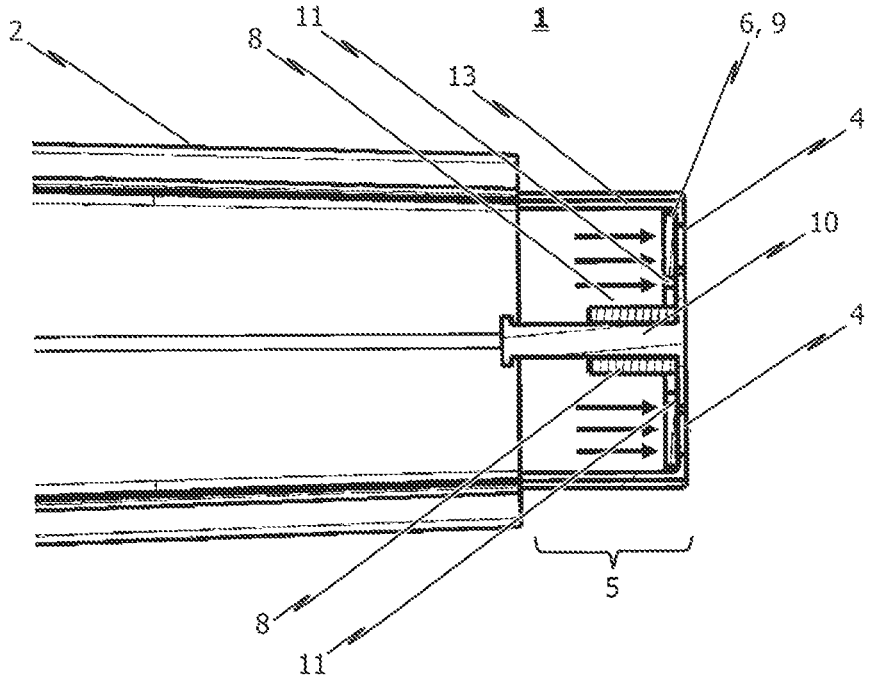
FIG. 3 shows schematically the region of the wash arm according to FIG. 2 in a state in which the cleaning openings which are provided are closed.

In detail, FIG. 2 shows the exemplary embodiment of the wash arm 1 according to the invention in a state in which the cleaning openings 4 are open, while the wash arm 1 in FIG. 3 is shown in a state in which the cleaning openings 4 are correspondingly closed.

The embodiment of the wash arm 1 according to the invention that is shown schematically in FIG. 2 and FIG. 3 has a wash arm housing 2 which extends in a longitudinal direction and in which at least one inlet for supplying washing liquid and at least one nozzle opening for spraying the supplied washing liquid are formed. The inlet and the nozzle openings are not explicitly shown in FIG. 2 and FIG. 3.

In each case at least one cleaning opening 4 with an assigned opening/closing mechanism 5 is provided at at least one, and preferably at both, opposite end regions of the wash arm housing 2. The at least one cleaning opening 4 is in each case provided here—as shown in FIG. 2 and FIG. 3—in an end side of the wash arm housing 2 and points in particular in the longitudinal direction in which the wash arm housing 2 also extends.

Although it is conceivable in principle that the opening/closing mechanism 5 has an electrically and/or magnetically actuable actuating element for opening and/or closing the at least one cleaning opening 4 as required, in the embodiment of the wash arm 1 according to the invention that is shown schematically in FIG. 2 and FIG. 3 it is provided that the opening/closing mechanism 5 has a hydraulically actuable actuating element for opening and/or closing the at least one cleaning opening 4 as required.

In principle, the opening/closing mechanism 5 used here acts in the manner of a linearly acting non-return valve.

In detail, the opening/closing mechanism 5 used in the wash arm 1 according to FIG. 2 and FIG. 3 has a shut-off slide 6 which is mounted in the corresponding end region of the wash arm 1 in such a manner that the shut-off slide 6 is displaceable in a pure linear movement relative to the wash arm housing 2 and relative to the at least one cleaning opening 4, which is assigned to the opening/closing mechanism 5, between an open position (cf. FIG. 2) and a closed position (cf. FIG. 3). In the open position shown in FIG. 2, the at least one cleaning opening 4 is fluidically connected to the inlet of the wash arm 1 while, in the closed position shown in FIG. 3, a fluidic connection between the at least one cleaning opening 4 and the inlet is interrupted.

As can furthermore be gathered from the illustrations in FIG. 2 and FIG. 3, in the embodiment which is shown in these drawings it is provided that the shut-off slide 6 of the opening/closing mechanism 5 has a guide sleeve 8 and a shut-off body 9 protruding radially from the guide sleeve 8. The guide sleeve 8 of the shut-off slide 6 is mounted in a linearly movable manner on a guide pin 10 extending in the longitudinal direction of the wash arm housing 2.

The guide pin 10 preferably has an axis of longitudinal extent which is formed coaxially with respect to an axis of longitudinal extent of the wash arm housing 2.

As indicated in particular in FIG. 2, the shut-off body 9 of the shut-off slide 6 has at least one passage 11, the passage opening of which pointing in the direction of the end side of the wash arm housing 2 is positioned/placed in such a manner that, in the closed position of the shut-off slide 6 (cf. FIG. 3), the passage opening pointing in the direction of the end side of the wash arm housing 2 does not coincide with the at least one cleaning opening 4.

In particular, it is provided here that the passage opening of the at least one passage 11, said passage opening pointing in the direction of the end side of the wash arm housing 2, is arranged closer in a radial respect to the axis of extent of the wash arm 1 with respect to the axis of longitudinal extent of the wash arm housing 2 than the at least one cleaning opening 4.

It is indicated in FIG. 3 that the shut-off body 9 of the shut-off slide 6 has an effective control surface pointing in the longitudinal direction of the wash arm housing 2, wherein the effective control surface pointing in the longitudinal direction of the wash arm housing 2 is previously definable in such a manner that, when said control surface is acted upon with a previously defined or definable minimum washing liquid pressure in the wash arm housing 2, the shut-off body 9 is transferred into the closed position of the opening/closing mechanism 5.

Figure 4:
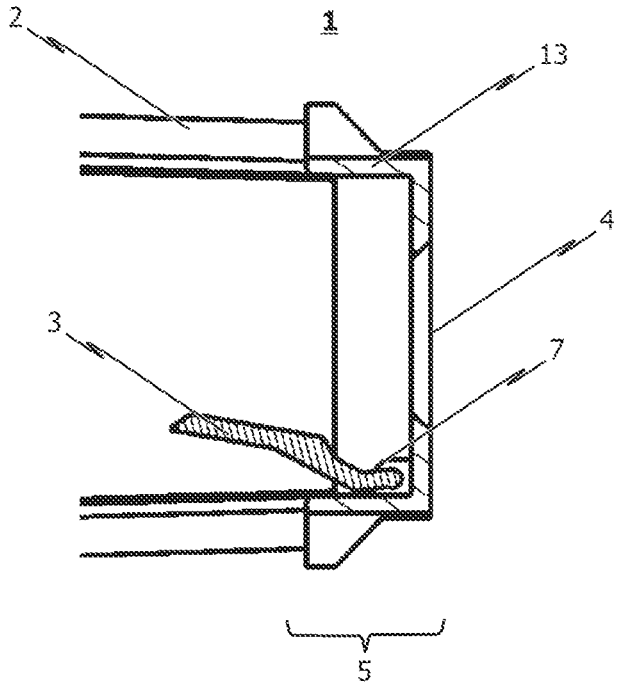
FIG. 4 shows, schematically and in a sectional view, an end region of a second embodiment of the wash arm of the exemplary embodiment of the dishwasher according to the invention in a state in which the cleaning openings provided on the end side in the wash arm are open.
Figure 5:
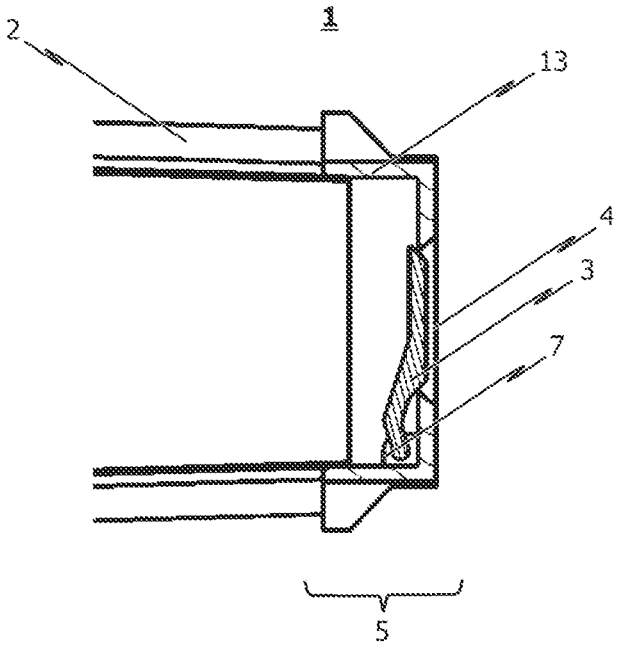
FIG. 5 shows schematically the region of the wash arm according to FIG. 4 in a state in which the cleaning openings which are provided are closed.

A second exemplary embodiment of the wash arm 1 according to the invention will be described in more detail below with reference to the illustrations in FIG. 4 and FIG. 5.

In this embodiment, the opening/closing mechanism 5, preferably in the corresponding end region of the wash arm 1, has a pivoting element 3 which serves as a shut-off body. The pivoting element 3 is designed and/or mounted in such a manner that the pivoting element 3 is pivotable in a preferably pure pivoting movement relative to the wash arm housing 2 and relative to the at least one cleaning opening 4, which is assigned to the opening/closing mechanism 5, between an open position (cf. FIG. 4), in which the at least one cleaning opening 4 is fluidically connected to the inlet of the wash arm 1, and a closed position (cf. FIG. 5), in which a fluidic connection between the at least one cleaning opening 4 and the inlet is interrupted.

The pivoting element 3 here is preferably assigned a pretensioning element 7, in particular in the form of a spring, with which the pivoting element 3 is pretensioned into its open position.

The pretensioning force exerted on the pivoting element 3 by the pretensioning element 7 and/or the open position of the pivoting element 3 are/is preferably selected in such a manner that the pretensioning force is overcome as soon as a static pressure in the interior of the wash arm housing 2 reaches or exceeds a previously defined or definable minimum pressure value.

Figure 6:
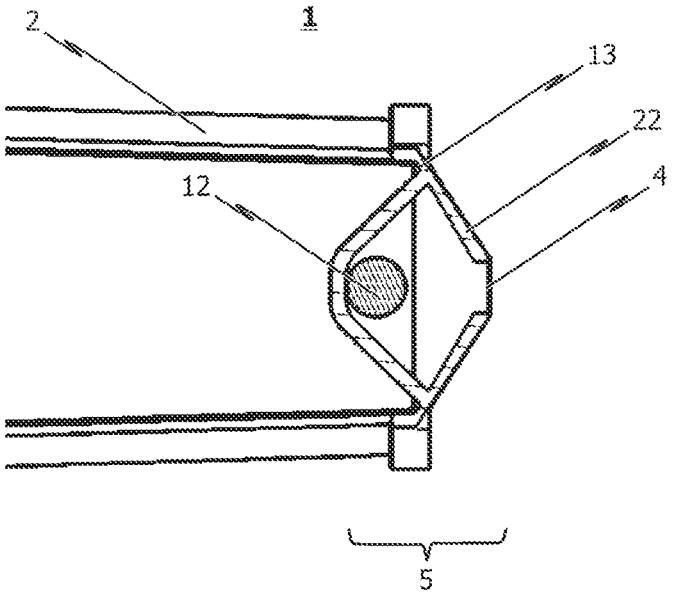
FIG. 6 shows, schematically and in a sectional view, an end region of a third embodiment of the wash arm of the exemplary embodiment of the dishwasher according to the invention in a state in which the cleaning openings provided on the end side in the wash arm are open.
Figure 7:
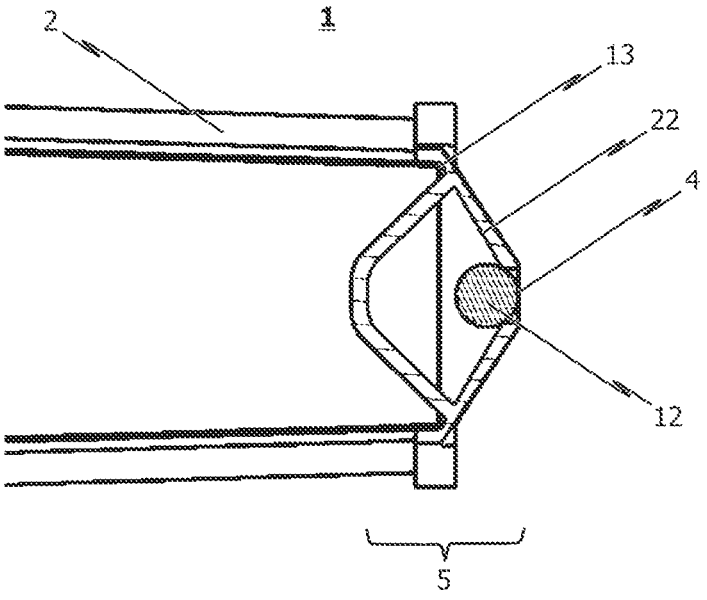
FIG. 7 shows schematically the region of the wash arm according to FIG. 6 in a state in which the cleaning openings which are provided are closed.

A third exemplary embodiment of the wash arm 1 according to the invention will be described in more detail below with reference to the illustrations in FIG. 6 and FIG. 7.

In this embodiment, the opening/closing mechanism 5, preferably in the corresponding end region of the wash arm 1, has an in particular spherical closure element 12 which is accommodated in a cage region 22, serves as a shut-off body and is designed and/or mounted in the cage region 22 in such a manner that the closure element 12 is movable relative to the wash arm housing 2 and relative to the cage region 22 and relative to the at least one cleaning opening 4, which is assigned to the opening/closing mechanism 5, between an open position (cf. FIG. 6), in which the at least one cleaning opening 4 is fluidically connected to the inlet of the wash arm 1, and a closed position (cf. FIG. 7), in which a fluidic connection between the at least one cleaning opening 4 and the inlet is interrupted.

The closure element 12 and the cage region 22 here are preferably designed in such a manner that the closure element 12 is transferred by the water pressure prevailing in the interior of the wash arm housing 2 into its closed position and is held there as soon as a static pressure in the interior of the wash arm housing 2 reaches or exceeds a previously defined or definable minimum pressure value, and that the closure element 12 transfers by gravity into its open position as soon as a static pressure in the interior of the wash arm housing 2 falls short of the previously defined or definable minimum pressure value.

In all of the above-described embodiments, it is provided in particular that the shut-off body 9 or the pivoting element 3 serving as the shut-off body or the closure element 12 serving as the shut-off body has an effective control surface pointing in the longitudinal direction of the wash arm housing 2, wherein the effective control surface pointing in the longitudinal direction of the wash arm housing 2 is previously definable in such a manner that, when said control surface is acted upon with a previously defined or definable minimum washing liquid pressure in the wash arm housing 2, the shut-off body 9 or the pivoting element 3 serving as the shut-off body or the closure element 12 serving as the shut-off body is transferred into the closed position of the opening/closing mechanism 5.

In particular, the opening/closing mechanism 5 is thus designed to preferably automatically close the at least one cleaning opening 4 as soon as a static pressure in the interior of the wash arm housing 2 reaches or exceeds a previously defined or definable minimum pressure value, wherein the opening/closing mechanism 5 is furthermore designed to open the at least one cleaning opening 4 if the static pressure in the interior of the wash arm housing 2 falls below the previously defined or definable minimum pressure value.

The opening/closing mechanism 5 of the wash arm 1 is accommodated in a dedicated housing 13, wherein the housing 13 of the opening/closing mechanism 5 is fastenable, preferably releasably, to the wash arm housing 2, which is open at its end region.

At least a few of the aspects according to the invention will be briefly summarized below:

The wash arm 1 according to the invention is generally suitable for automatic cleaning systems, and in particular for commercial single-tank or multi-tank dishwashers, such as box-type warewashers or dishwashers with a conveyor system, such as, for example, a rack conveyor warewasher or flight-type warewasher. The dishwashers are provided with a rotating or stationary washing and rinsing system. The associated wash arm here has wash nozzles and at least one closeable cleaning opening 4 which has an automatic opening/closing mechanism 5 such that the wash arm 1 can be thoroughly rinsed at regular intervals.

The cleaning openings serve in particular to thoroughly wash the wash arm at intervals at least once per day and preferably once per program cycle and ideally twice per program cycle.

According to a preferred realization, the cleaning openings arranged on the end side on the wash arm 1 also serve as spray nozzles for spraying liquid onto the inner wall of the treatment chamber or treatment zone of the dishwasher. In this case, the cleaning openings therefore have a dual function since the cleaning openings also serve as cleaning nozzles for cleaning the interior of the dishwasher.

The invention is not restricted to the exemplary embodiments shown in the drawings, but emerges from an overall view of all of the herein disclosed features.

LIST OF REFERENCE SIGNS

1 Wash arm
2 Wash arm housing
3 Pivoting element
4 Cleaning opening
5 Opening/closing mechanism
6 Shut-off slide/shut-off body
7 Pretensioning element
8 Guide sleeve of the shut-off slide
9 Shut-off body of the shut-off slide
10 Guide pin
11 Passage in the shut-off body
12 Spherical closure element
13 Housing of the opening/closing mechanism
14 Wash tank
15 Wash pump
16 Boiler
17 Washing line system
18 Fresh water line system
19 Wash nozzles
20 Rinsing arm
21 Rinsing nozzles
22 Cage region of the spherical closure element
30 Storage container of final rinsing solution
50 Dishwasher
51 Treatment chamber

What is claimed is:

1. A wash arm of a commercial dishwasher, the wash arm comprising:

a wash arm housing which extends in a longitudinal direction and in which at least one inlet for supplying washing liquid and at least one nozzle opening for spraying the supplied washing liquid are formed, wherein at least one cleaning opening with an assigned opening/closing mechanism is provided at at least one end region of the wash arm housing, wherein the opening/closing mechanism is designed to automatically open for thorough rinsing of at least one region of the wash arm housing as required and to automatically close for ending the thorough rinsing of the at least one region of the wash arm housing as required;

wherein the opening/closing mechanism has a shut-off slide which is mounted in the corresponding end region of the wash arm in such a manner that the shut-off slide is displaceable in a linear movement relative to the wash arm housing and relative to the at least one cleaning opening, which is assigned to the opening/closing mechanism, between an open position, in which the at least one cleaning opening is fluidically connected to the inlet of the wash arm, and a closed position, in which a fluidic connection between the at least one cleaning opening and the inlet is interrupted, wherein the shut-off slide has a guide sleeve and a shut-off body protruding radially from the guide sleeve, wherein the guide sleeve is mounted in a linearly movable manner on a guide pin extending in the longitudinal direction of the wash arm housing.

2. The wash arm as claimed in claim 1, wherein the opening/closing mechanism is designed to automatically close the at least one cleaning opening as soon as a static pressure in the interior of the wash arm housing reaches or exceeds a minimum pressure value, wherein the opening/closing mechanism is furthermore designed to open the at least one cleaning opening if the static pressure in the interior of the wash arm housing falls below the minimum pressure value.

3. The wash arm as claimed in claim 1, wherein the at least one cleaning opening is in each case provided in an end side of the wash arm housing and points in the longitudinal direction, in which the wash arm housing extends, and wherein the guide pin has an axis of longitudinal extent which is formed coaxially with respect to an axis of longitudinal extent of the wash arm housing.

4. The wash arm as claimed in claim 3, wherein the shut-off body has at least one passage, the passage opening of which pointing in the direction of the end side of the wash arm housing is placed in such a manner that, in the closed position of the shut-off slide, the passage opening pointing in the direction of the end side of the wash arm housing does not coincide with the at least one cleaning opening, wherein the passage opening of the at least one passage, said passage opening pointing in the direction of the end side of the wash arm housing, is spaced apart less far in the radial direction with respect to the axis of longitudinal extent of the wash arm housing from an axis of extent of the wash arm than the at least one cleaning opening.

5. The wash arm as claimed in claim 1, wherein the opening/closing mechanism is accommodated in a housing, wherein the housing of the opening/closing mechanism is fastenable, releasably, to the wash arm housing, which is opened at its open end, wherein the at least one cleaning opening is provided on an end-side end region of the housing of the opening/closing mechanism.

6. The wash arm as claimed in claim 1, wherein the wash arm is mounted rotatably about an axis of rotation, wherein the axis of rotation runs through the inlet of the wash arm.

7. A rinsing arm system for a commercial dishwasher, wherein the rinsing arm system has at least one wash arm as claimed in claim 1 and at least one rinsing arm, which is formed separately from the at least one wash arm, for spraying rinsing liquid.

8. A commercial dishwasher with at least one wash arm as claimed in claim 1, wherein the dishwasher has at least one treatment chamber or at least one treatment zone, in which washing liquid and/or rinsing liquid is sprayed, wherein the at least one wash arm as claimed in claim 1 is provided for spraying the washing liquid and/or the rinsing liquid.

9. A wash arm of a commercial dishwasher, the wash arm comprising:

a wash arm housing which extends in a longitudinal direction and in which at least one inlet for supplying washing liquid and at least one nozzle opening for spraying the supplied washing liquid are formed, wherein at least one cleaning opening with an assigned opening/closing mechanism is provided at at least one end region of the wash arm housing, wherein the opening/closing mechanism is designed to automatically open for thorough rinsing of at least one region of the wash arm housing as required and to automatically close for ending the thorough rinsing of the at least one region of the wash arm housing as required;

wherein the opening/closing mechanism has a non-return valve, wherein the non-return valve has a shut-off body which is displaceable relative to the wash arm housing and relative to the at least one cleaning opening, which is assigned to the opening/closing mechanism, in a linear movement between an open position, in which the at least one cleaning opening is fluidically connected to the inlet of the wash arm, and a closed position, in which a fluidic connection between the at least one cleaning opening and the inlet is interrupted.

10. A commercial dishwasher with at least one wash arm as claimed in claim 9, wherein the dishwasher has at least one treatment chamber or at least one treatment zone, in which washing liquid and/or rinsing liquid is sprayed, wherein the at least one wash arm as claimed in claim 9 is provided for spraying the washing liquid and/or the rinsing liquid.

11. A wash arm of a commercial dishwasher, the wash arm comprising:

a wash arm housing which extends in a longitudinal direction and in which at least one inlet for supplying washing liquid and at least one nozzle opening for spraying the supplied washing liquid are formed, wherein at least one cleaning opening with an assigned opening/closing mechanism is provided at at least one end region of the wash arm housing, wherein the opening/closing mechanism is designed to automatically open for thorough rinsing of at least one region of the wash arm housing as required and to automatically close for ending the thorough rinsing of the at least one region of the wash arm housing as required;

wherein the opening/closing mechanism has an in particular spherical closure element which is accommodated in a cage region, serves as a shut-off body and is designed and/or mounted in the cage region in such a manner that the closure element is movable relative to the wash arm housing and relative to the cage region and relative to the at least one cleaning opening, which is assigned to the opening/closing mechanism, between an open position, in which the at least one cleaning opening is fluidically connected to the inlet of the wash arm, and a closed position, in which a fluidic connection between the at least one cleaning opening and the inlet is interrupted, wherein the closure element and the cage region are designed in such a manner that the closure element is transferred by the water pressure prevailing in the interior of the wash arm housing into its closed position and is held there as soon as a static pressure in the interior of the wash arm housing reaches or exceeds a minimum pressure value, and that the closure element transfers by gravity into its open position as soon as a static pressure in the interior of the wash arm housing falls short of the minimum pressure value.

12. A commercial dishwasher with at least one wash arm as claimed in claim 11, wherein the dishwasher has at least one treatment chamber or at least one treatment zone, in which washing liquid and/or rinsing liquid is sprayed, wherein the at least one wash arm as claimed in claim 11 is provided for spraying the washing liquid and/or the rinsing liquid.

* * * * *